United States Patent [19]

Gibson

[11] 4,342,060

[45] Jul. 27, 1982

[54] ENERGY INTERLOCK SYSTEM FOR A LINEAR ACCELERATOR

[75] Inventor: Robert Gibson, Walnut Creek, Calif.

[73] Assignee: Siemens Medical Laboratories, Inc., Walnut Creek, Calif.

[21] Appl. No.: 152,484

[22] Filed: May 22, 1980

[51] Int. Cl.[3] ..... H05G 1/46

[52] U.S. Cl. ..... 361/1; 361/187; 361/83; 328/233; 378/110

[58] Field of Search ..... 361/1, 79, 83, 93, 186, 361/187; 250/409, 445, 396, 385; 328/233, 259, 10

[56] References Cited

U.S. PATENT DOCUMENTS

| | | | |
|---|---|---|---|
| 3,691,377 | 9/1972 | Matsui et al. | 328/233 |
| 3,808,441 | 4/1974 | Boux | 250/385 |
| 3,936,756 | 2/1976 | Someya et al. | 328/10 |
| 3,942,012 | 3/1976 | Boux | 250/385 |
| 3,955,089 | 5/1976 | McIntyre et al. | 250/385 |
| 3,965,434 | 6/1976 | Helgesson | 328/233 |
| 4,115,830 | 9/1978 | Stieber . | |
| 4,142,103 | 2/1979 | Mester et al. | 250/409 |
| 4,144,551 | 3/1979 | Smith et al. | 361/87 X |
| 4,229,704 | 10/1980 | Lewis | 328/233 |
| 4,230,944 | 10/1980 | Wiegman et al. | 250/409 |
| 4,234,793 | 11/1980 | Amtmann | 250/409 |

FOREIGN PATENT DOCUMENTS

| | | | |
|---|---|---|---|
| 1245502 | 7/1967 | Fed. Rep. of Germany | 250/95 |
| 2517139 | 10/1976 | Fed. Rep. of Germany | 250/409 |
| 1944481 | 2/1979 | Fed. Rep. of Germany | 250/409 |
| 139782 | 1/1980 | German Democratic Rep. | 361/1 |
| 455320 | 8/1966 | Japan | 328/233 |
| 50-2759 | 9/1975 | Japan | 328/233 |

OTHER PUBLICATIONS

"Mevatron 20" by Siemens AG, West Germany, Order No. MT 3/1702.101-WS 5791.

"Mevatron 60, Data" by Siemens AG, West Germany, Order No. MT 3-6027.101-PA 9783.

*Primary Examiner*—J. D. Miller

*Assistant Examiner*—L. C. Schroeder

*Attorney, Agent, or Firm*—Spellman, Joel and Pelton

[57] ABSTRACT

The energy interlock system contains a measuring device, a discriminator and a switch. The measuring device determines the level of the particle beam pulses which are emitted by the accelerator. For this purpose it contains a target which is exposed to the particle beam pulses. The discriminator determines whether the level of the particle pulses has crossed a predetermined value. The switch is operated by the discriminator. It is connected for supervision of the accelerator.

10 Claims, 3 Drawing Figures

ENERGY INTERLOCK SYSTEM FOR A LINEAR ACCELERATOR

BACKGROUND OF THE INVENTION

1. Field of the Invention

This invention relates to an energy monitoring system for the supervision of a particle accelerator, preferably of a linear accelerator. Particularly, this invention relates to an electron energy interlock system for an electron linear accelerator of the type having no electron beam bending system which may act as an electron energy band pass.

2. Description of the Prior Art

It is known in the art of radiation systems of various types to switch off the radiation beam via an ionization chamber to which the radiation is applied, as soon as a previously determined dosage of radiation has been reached. Particularly in the case of particle accelerators, such as linear accelerators, it is known to use monitoring systems which control dosage and dosage rate during treatment and which ensure automatic termination of radiation if preset values are exceeded (see brochure "Mevatron 20" by Siemens AG, West Germany, Order No. MT 3/1702.101-WS 5791, particularly see page 9). Such safety interlock systems may be applied in linear accelerators in which the dose rate is uniformly fixed for X-ray and electron irradiation of all energies, such as to a value of 300 rad/min in the flattened field at 100 cm FD (see brochure "Mevatron 20", supra), or in linear accelerators in which the dose rate is continuously variable between a lower and an upper limit (see brochure "Mevatron 60, Data" by Siemens AG, West Germany, Order No. MT 3-6027.101-PA 9783).

U.S. Pat. No. 4,115,830 discloses a monitoring system. for the high voltage supply of an ionization chamber. This system is preferably used for monitoring a particle accelerator. In the field of particle accelerators, it is known to regulate the radiation intensity or radiation output via the ionization current of an ionization chamber subjected to the radiation in such a way that the number of radiation pulses per time unit is changed in correspondence with the chamber signal measured. To overcome inaccuracies in the ionization current measurement below a minimum value of the high voltage supplied to the chamber, the monitoring system is provided. The monitoring system comprises a switch member which is associated with a safety circuit of the particle accelerator and which switches off the latter in the event of insufficient high voltage.

It is desirable to provide another interlock system for a particle accelerator, namely an energy interlock system that interlocks the accelerator in case of undesired energy changes of the radiation output. Such an energy interlock system for the accelerated electrons and/or X-rays is especially important in a linear accelerator which does not dispose of an electron beam bending system (see, for instance, brochure "Mevatron 60", supra). Such an electron bending system, usually a bending magnet system, commonly works as an energy filter or band pass for accelerated electrons (see, for enstance, brochure "Mevatron 20", supra). A linear accelerator of the type having no electron beam bending system may experience a drift of signals from its mechanical and electrical components which leads to an electron output energy that is too high or too low for the intended irradiation process. Even though a dose monitoring system and a dose rate monitoring system may be working properly, a patient who is irradiated by the accelerator should be protected from too high or too low electron or X-ray energies.

Assume, for instance, that a linear accelerator disposes of a dose rate control or servo circuit. If for some reason (for instance: drift of components or source variations) the beam current which may be measured by an ionization chamber indicates an increase, while the radio frequency supplied by the HF source of the accelerator remains unchanged, the energy of the accelerated electrons and/or X-rays will increase. Such an increase in energy has to be avoided, as soon as a preset maximum energy value is reached. However, if by some reasons (drift of components) the radio frequency power supplied by the HF source of the accelerator should increase, while the output dose rate (in r/min) is kept constant by the dose rate control circuit, the energy of the accelerated electrons and/or X-rays would also increase. Such energy increase has to be stopped, as soon as the preset maximum energy level is reached. The same applies to energies which are too low. A decrease in energy should be stopped, as soon as a preset minimum energy level is reached.

SUMMARY OF THE INVENTION

1. Objects

An object of this invention is to provide an energy monitoring system for the supervision of a particle accelerator.

Another object of this invention is to provide an energy monitoring system for the supervision of a linear accelerator, particularly of a linear accelerator having no electron beam bending system which works as an energy filter for the accelerator electrons.

Still another object of this invention is to provide an energy interlock system for a linear accelerator that ensures automatic termination of radiation when the electron energy exceeds an upper electron energy level and/or falls below a lower electron energy level.

Still another object of this invention is to provide an interlock system for a linear accelerator that is not affected by control circuits of the linear accelerator such as a dose rate control circuit.

It is still another object of this invention to provide an interlock system for a linear accelerator that is easy to construct and reliable in its function.

Still other objects will become apparent in the course of the following description.

2. Summary

According to this invention, an energy monitoring system for the supervision of a particle accelerator delivering beam pulses incorporates measuring means for measuring the level of said beam pulses, descriminator means for connection to the measuring means and determining if the levels of the particle beam pulses have crossed a predetermined value, and switch means for connection to the descriminator means and to the particle accelerator for supervising the operation of the particle accelerator.

As mentioned above, the information for the energy monitoring system is taken from the beam pulses. In the case of a linear accelerator, the level of these pulses, which may be particularly derived from a target which is exposed to the accelerated electrons, is indicative of the electron and/or X-ray energy of the accelerator.

The output signal of the discriminator means is used as an interlock signal. This interlock signal may be rendered when the energy of the accelerated electrons and/or X-rays is above a predetermined maximum value. Particularly, it may also be rendered when that energy is below a predetermined minimum value. The interlock signal may, for instance, interlock simultaneously the high voltage of the accelerator, the RF voltage of the HF source and the injection of the electron source which is adapted to inject electrons into the accelerator tube. By keeping the energy between the maximum and the minimum energy value, the irradiation process can be exactly predetermined by the operator of the accelerator, and thus, for instance, an irradiated patient is protected.

The foregoing and other objects, features and advantages of the invention will be apparent from the following more particular description of the preferred embodiment of the invention, as illustrated in the accompanying drawings.

DESCRIPTION OF THE PREFERRED EMBODIMENT

Figure 1:
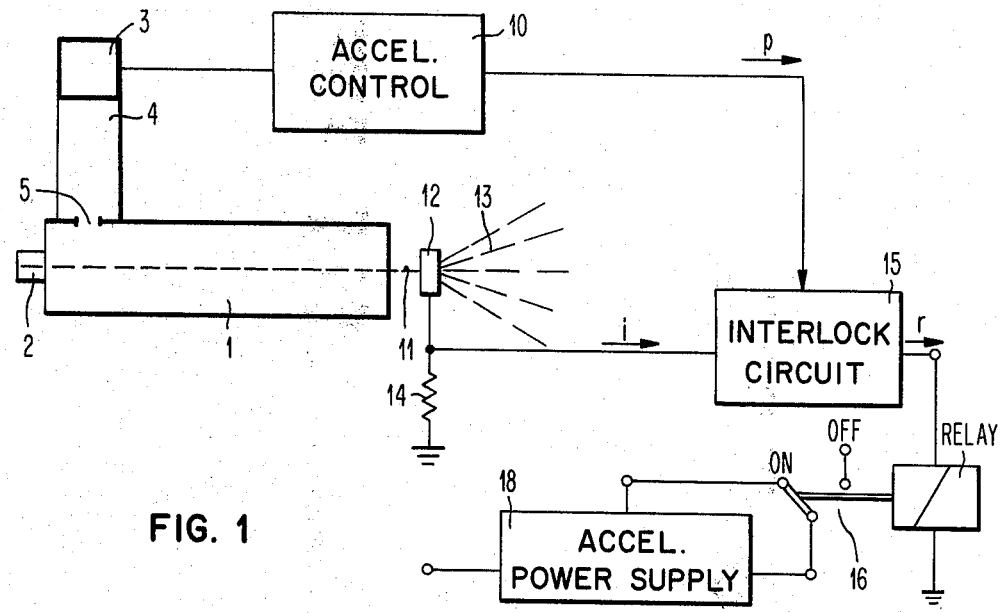
FIG. 1 is a general schematic view of a linear accelerator incorporating the invention.

With reference to FIG. 1, a linear accelerator is shown comprising a conventional wave guide 1 for accelerating electrons. The wave guide 1 is adapted to receive the electrons to be accelerated on one side from an electron emitting and injection device, which is referred to as electron gun 2. The wave guide 1 may consist of a hollow tube into which is introduced an electromagnetic wave from a suitable high frequency or radio frequency source 3 via a coupling or introducing element 4 and an input window 5.

The source 3 of high frequency energy may embody a high frequency oscillator, such as a magnetron or klystron. The oscillator is of the type which comprises adjustment devices that can be set by electrical signals. These devices, which can be of any well known type, are controlled by an accelerator control device 10. This control device 10 is also of a kind well known in the art. It includes, for instance, a dosage rate control circuit.

Electrons introduced into the wave guide 1 are accelerated at high energy by the electromagnetic wave inside the wave guide 1. A pulsed stream of electrons 11 emerges from the delivery end of the wave guide 1 and arrives at a target 12. The target 12 may be of any conventional material, for instance, of gold or platinum. The accelerated electrons directed onto the target 12 generate X-ray pulses 13. Either the accelerated electrons 11 or the X-ray pulses 13 may be used for medical treatment.

It should be noted that no beam bending system is used. Conventionally such a bending system is arranged at the delivery end of the accelerator for bending the beam of accelerated electrons to a desired angle. Thus the conventional bending magnet system acts as an energy band pass for the accelerated electrons.

The target 12 is part of a pulse measuring device. Another part of this pulse measuring device is a measuring resistor 14 which is connected between the target 12 and ground. The pulsed current flowing through the resistor 14 is a measure of the intensity of the electron beam pulses leaving the wave guide 1. The voltage of the resistor 14 is picked up and introduced into an interlock circuit 15. This voltage is proportional to the beam current.

Figure 2:
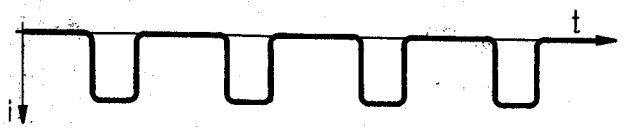
FIG. 2 is a diagram of the pulsed beam current determined in FIG. 1.

Generally speaking, the pulse measuring device is such that it generates a beam current signal i made up of a chain of relatively broad current pulses. Such a chain i of current pulses is shown in FIG. 2. In a linear accelerator, typically each of these pulses may be two microseconds wide. It shall be noted that all pulses have a flat top. The flat top or, in other words: the level of the electron beam pulses, is of particular interest for the further processing of the beam current signal i.

The interlock circuit 15 contains means for measuring the flat top or the level of the individual pulses. The interlock circuit 15 further contains a discriminator which determines if each of these levels has exceeded one or more predetermined value(s).

If the measured beam current and correspondingly the amplitude of the measured signal pulses signal i (see FIG. 2) exceed the predetermined value(s) preset in the discriminator, the discriminator changes its output signal r and activates a switch member 16. The switch member 16 is shown as a relay, the switch arm of which controls the ON and OFF position of the power supply 18 for the linear accelerator. The switch member 16 will switch off the power supply 18 in the event of an insufficient and/or a too high electron energy. This will be explained in more detail when FIG. 4 will be discussed. Switching off of the power supply 18 is a measure for the patient's safety. It is a safeguard against individual component problems, in particular against the failure of transistors in the accelerator control device 10 which would have the effect of increasing and/or decreasing the electron beam energy above and/or below the predetermined value, respectively.

It should be mentioned that the invention is not limited to switching off the power supply 18 of the linear accelerator. Instead, the interlock circuit 15 and the switch member 16 can also turn off the RF voltage of the HF power source 3 and/or the emission of electrons of the electron gun 2 or switch off the accelerator in another way.

Thus, the combination of the measuring device 12, 13, the interlock circuit 15 and the switch member 16 provides for supervising the proper operation of the linear accelerator.

Figure 3:
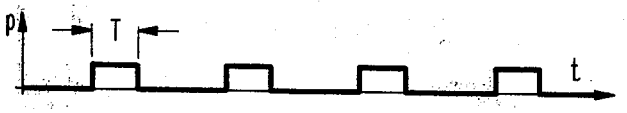
FIG. 3 is a diagram of a trigger signal used in FIG. 1.

In FIG. 3 is illustrated a commonly used trigger signal p of the accelerator control 10 in dependence of the time t. The pulses in the trigger signal p are of the length T. The time T indicates the pulse length of the electron output pulses.

Figure 4:
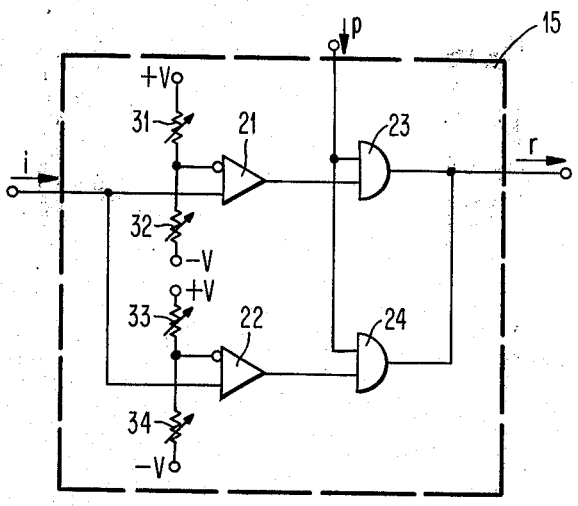
FIG. 4 is an embodiment of an interlock circuit which can be used in the accelerator of FIG. 1.

In FIG. 4 is shown a preferred embodiment of the interlock circuit 15. This circuit 15 delivers an interlock output signal r (and thus interlocks the linear accelerator) when the energy of the X-rays 13 is above a predetermined upper value, and also when the energy of the X-rays 13 is below a predetermined lower value. As long as the energy is kept between these two predetermined energy limits, no switch-off operation will occur.

According to FIG. 4, the interlock circuit 15 contains a first comparator 21, a second comparator 22, a first gate 23 and a second gate 24.

The first input of the first comparator 21 is supplied with the beam current signal i from the measuring device 14. The second input is connected to an adjusting device for the upper predetermined value. This adjusting device is formed by two adjustable resistors 31 and 32 which are connected in series relationship between a supply voltage source having the voltages +V and −V. The connection point between the two resistors 31, 32 is connected to the second input of the first comparator 21. This second input is an inversing input. The output of the first comparator 21 is connected to a first input of the first gate 23. To the second input of this first gate 23 is supplied the trigger signal p. The output of the first gate 23 delivers the output signal r. It is connected to the switching member 16.

The second comparator 22 and the second gate 24 are connected together in a similar way. The first input of the second comparator 22 is connected to receive the beam current signal i, and the second input, which is an inversing input, is connected to the connection point of two series connected resistors 32 and 34 which are both adjustable. The series connection of the resistors 33 and 34 is connected between a supply voltage source having the voltage +V, −V. The adjustable resistors 33 and 34 serve to set the lower predetermined value. The output of the second comparator 22 is connected to the first input of the second gate 24. The second input of the second gate 24 is supplied with the trigger signal p. The output of the second gate 24 is connected to the output of the first gate 23.

As will be seen from FIG. 4, the trigger signal p turns on the gates 23 and 24 for the ON time T of the pulses in the beam current signal i. As soon as the amplitude of a pulse of the beam current signal i will exceed the predetermined upper value determined by resistors 31, 32, the first comparator 21 will issue an output signal r to cut off the pulsed stream 13 of accelerated electrons directed to the target 12. However, as soon as the amplitude of a pulse in the signal i drops below the predetermined lower value, the second comparator 22 will issue an output signal; this signal will also interrupt the stream of accelerated electrons. Thus an effective energy interlock system for a linear accelerator having no bending magnet system which otherwise could act as an energy filter has been provided.

While the energy interlock system described above constitutes a preferred embodiment, it is to be understood that a variety of changes may be made without affecting the range and scope of this invention.

What is claimed is:

1. An energy monitoring system for supervision of a particle accelerator, which emits particle beam pulses, comprising in combination;

(a) means for measuring the level of the particle beam pulses, said means including a target which is exposed to said particle beam pulses for deriving a signal responsive to said particle beam pulses;

(b) discriminator means connected to said measuring means for determining if the level of said particle beam pulses has crossed a predetermined value; and (c) switch means operated by said descriminator means and connected to said particle accelerator for interlocking the operation of said accelerator.

2. The energy monitoring system according to claim 1, wherein said particle accelerator is a linear electron accelerator.

3. The energy monitoring system according to claim 2, wherein said linear accelerator is of the type having no electron bending system.

4. The energy monitoring system according to claim 1, wherein said switch means interlock the high voltage of said accelerator.

5. The energy monitoring system according to claim 1, wherein said switch means interlock the high frequency voltage of said accelerator.

6. The energy monitoring system according to claim 1, wherein said switch means interlock the electron source of said accelerator.

7. The energy monitoring system according to claim 1, wherein said discriminator means comprises a first comparator having a first and a second input and means for adjusting an upper predetermined value, said first input being connected to said measuring means and said second input being connected to said means for adjusting the upper predetermined value, and wherein said discriminator further comprises first gate means for connecting the output of said first comparator to said switch means in dependence of a trigger signal representative of the ON time of said particle beam pulses.

8. The energy monitoring system according to claim 1, wherein said discriminator means comprises a second comparator having a first and a second input and means for adjusting a lower predetermined value, said first input being connected to said measuring means and said second input being connected to said means for adjusting the lower predetermined value, and wherein said discriminator further comprises second gate means for connecting the output of said second comparator to said switch means in dependence of a trigger signal representative of the ON time of said particle beam pulses.

9. The energy monitoring system according to claim 7, wherein said first gate means is connected between the output of said first comparator and said switch means.

10. The energy monitoring system according to claim 8, wherein said second gate means is connected between the output of said second comparator and said switch means.

* * * * *